US005412924A

United States Patent [19]

Ausnit

[11] Patent Number: 5,412,924

[45] Date of Patent: May 9, 1995

[54] METHOD OF MAKING RECLOSABLE PLASTIC BAGS ON A FORM, FILL AND SEAL MACHINE

[75] Inventor: Steven Ausnit, New York, N.Y.

[73] Assignee: Minigrip, Inc., Orangeburg, N.Y.

[21] Appl. No.: 226,288

[22] Filed: Apr. 11, 1994

[51] Int. Cl.[6] ..... B65B 61/18; B65B 9/20

[52] U.S. Cl. ..... 53/412; 53/451; 53/551; 53/552; 53/133.4

[58] Field of Search ..... 53/412, 451, 551, 552, 53/133.4

[56] References Cited

U.S. PATENT DOCUMENTS

| | | | |
|---|---|---|---|
| 4,355,494 | 10/1982 | Tilman | 53/551 |
| 4,698,954 | 10/1987 | Behr et al. | 53/551 |
| 4,709,533 | 12/1987 | Ausnit | 53/552 X |
| 4,727,709 | 3/1988 | Zieke et al. | 53/551 |
| 4,840,012 | 6/1989 | Boeckmann | 53/552 X |
| 4,869,048 | 9/1989 | Boeckmann | 53/551 X |
| 4,894,975 | 1/1990 | Ausnit | 53/551 X |
| 4,993,212 | 2/1991 | Veoukas | 53/133.4 X |
| 5,014,497 | 5/1991 | McMahon | 53/551 X |
| 5,014,498 | 5/1991 | McMahon | 53/133.4 X |
| 5,046,300 | 9/1991 | Custer et al. | 53/133.4 X |
| 5,127,208 | 7/1992 | Custer et al. | 53/133.4 X |
| 5,322,579 | 6/1994 | Van Erden | 53/551 X |

*Primary Examiner*—Horace M. Culver
*Attorney, Agent, or Firm*—Kane, Dalsimer, Sullivan, Kurucz, Levy, Eisele and Richard

[57] ABSTRACT

In a method for forming reclosable packages on a conventional form-fill-and-seal machine, a "Y-type" zipper strip is fed toward and longitudinally down the filling spout thereof. A thermoplastic film is wrapped around the filling spout enclosing the zipper strip, and the lateral edges of the film are bonded together to form a longitudinal seam. The zipper strip webs are attached by sealing bars to the inside of the tube so formed from the thermoplastic film between the fill tube and the sealing bars. At intervals, transverse seams are formed to produce individual reclosable packages, which may also be separated from one another. The packages are filled with product during the course of their manufacture.

10 Claims, 5 Drawing Sheets

METHOD OF MAKING RECLOSABLE PLASTIC BAGS ON A FORM, FILL AND SEAL MACHINE

BACKGROUND OF THE INVENTION

1. Field of The Invention

The present invention relates to improvements in the manufacturing of reclosable plastic bags, and, more particularly, to a method which permits such bags to be formed as they are fed over a filling spout of a filling machine whereby the bags are formed and simultaneously filled with a product.

2. Description of the Prior Art

The art of making reclosable plastic bags provided with mating profiles which form a zipper to render the bags reclosable is well-defined in prior patents. Examples of such patents are U.S. Pat. Nos. 4,709,533; 4,894,975; and 5,046,300.

U.S. Pat. No. 4,709,533 shows an apparatus and a method wherein film is fed downwardly wrapped around a form-fill tube and the edges of the film are brought together pressed between pressing rollers guiding the edges together so that an outer seal can be formed. Means are provided for feeding interlocked zipper members between the film layers and between the rollers and the filling spout. Following the rollers, there are located uniquely positioned and shaped bars which include inner bars that have a space between them to guide the center portion of the zipper and these bars also form a backing for outer heated bars which seal the webs of the zipper to the inner surface of the bag film. The outer bars also extend around the edges of the bag to simultaneously form an outer security seal or lip seal. The thus formed and sealed zipper tube is filled through the spout and cross-seals with cross-cutters to complete the individual bags.

U.S. Pat. No. 4,894,975 also shows an apparatus and method wherein film is fed downwardly wrapped around a form-fill tube and the edges of the film are brought together in adjacency. The adjacent edges of the film are joined such as by heat sealing to interlocked zipper members, which thereafter form the sole juncture between the edges of the film and which zipper members provide a reclosable opening for the top of the completed bag. A web extends between the zipper strips, either above or below the interlocking elements, which web can be constructed of a weight and width with optimum characteristics for forming a security seal at the top of the bag and forming a tamper-evident seal. In a single rapid operation, a bag is formed wherein the film of the bag has optimum characteristics for the bag, and the plastic of the zipper and of the web therebetween have optimum characteristics for the functions of the zipper and functions of the security tamper-evident seal. The thus formed and sealed zipper tube is filled through the spout and cross-sealed with cross-cutters to complete the individual bags.

U.S. Pat. No. 5,046,300 shows a method and apparatus for forming reclosable packages wherein a flat packaging film is formed over a forming shoulder and into a tubular shape about a central member. The packaging film is advanced vertically downward along the length of the central member, and a reclosable profile element is threaded inside the tubular shape of the packaging film. The tubular packaging film is deformed to form a longitudinally extending loop of packaging film, and the interlocked zipper members are guided into the loop. The interlocked zipper members are then adhered to the inner surface of the loop of packaging film. The thus formed and sealed zipper tube is filled through the spout and cross-sealed with cross-cutters to complete the individual bags. It should be noted, that in each of the above described prior art methods some portion of the film is drawn away from the fill tube at substantially a right angle to the fill tube to receive the zipper strips. This additional film causes a problem of potential wrinkling of the film at the cross seal locations.

The present invention represents an improved approach toward the attachment of a reclosable profile element to a tubular packaging film, and toward the formation of a reclosable plastic bag, with product contents therein which does not require the film to be away from the fill tube.

SUMMARY OF THE INVENTION

Accordingly, in its broadest form, the present invention is a method for forming reclosable packages from a sheet of thermoplastic film on a form-fill-and-seal machine, wherein a continuous supply of zipper strip having first and second interlocking members is fed toward and longitudinally along a filling spout thereof.

A continuous supply of thermoplastic film is also fed toward the filling spout, and is wrapped therearound enclosing the zipper strip within the tube so formed. The lateral edges of the thermoplastic film are sealed together with a longitudinal seam to close the tube at a point away from the zipper location.

The webs of the zipper strip are then attached to the inside of the tube of thermoplastic film by sealing or welding them between the filling spout and sealing bars. The webs of the zipper strip are attached to the tube film in the plane of the tube film. Thereafter, periodically along the length of the tube transverse seams are formed to produce individual reclosable packages, which are separated from one another. The present invention will now be described in more complete detail with reference frequently being made to the figures identified as set forth below.

DETAILED DESCRIPTION OF THE PREFERRED EMBODIMENTS

Figure 1:
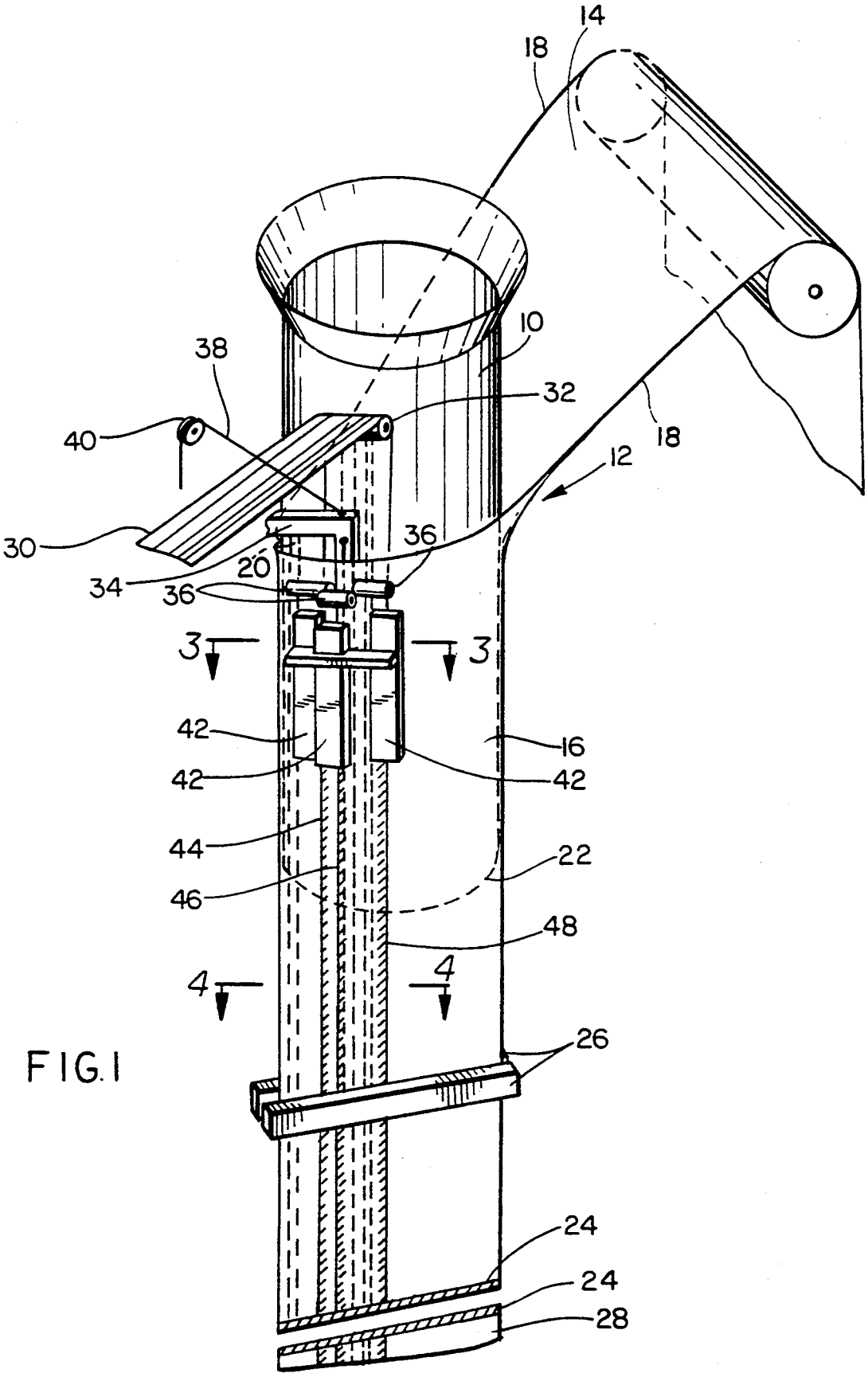
FIG. 1 is a simplified perspective view of a form-fill-and-seal machine on which reclosable packages may be made in accordance with the method of the present invention.

Reference is now made to the drawings, and to FIG. 1 in particular, wherein the filling spout 10 of a conventional vertical form-fill-and-seal machine 12 is depicted. In customary manner, a continuous supply of a film 14 is brought from a supply roll about suitable guides to be wrapped into a tube 16 about the filling spout 10. As the film 14 passes around the filling spout 10, the lateral edges 18 of the film are overlapped and a longitudinal seam 20 is formed by a heat sealing bar, not visible in the figure, in a manner quite familiar to those of ordinary skill in the art, so as to transform the film 14 into a tube 16 about the filling spout 10. As the tube 16 is advanced in stepwise fashion down the filling spout 10, it is flattened below the bottom 22 thereof. Transverse seams 24 are formed by heat sealing bars 26, which seal the bottom of the tube 16, as well as the top of the bag 28 made immediately therebefore, and a predetermined amount of product (not shown) is dropped through the filling spout 10 into the tube. The tube is then advanced a predetermined distance and the process is repeated. The heat sealing bars 26 also separate each filled and sealed bag 28 from the bottom of the tube 16. The tube is then advanced a predetermined distance and the process is repeated.

In accordance with the present invention, a zipper strip 30 is fed from a supply roll (not shown) and past a guide roller 32 to abut directly against the outside of the filling spout 10 above the point where the film 14 is wrapped therearound. The zipper strip 30 has a Y-type construction, as will be shown more clearly in subsequent figures, and is guided on the outside surface of the filling spout 10 by an anvil 34, which extends into the vertex of its Y-type construction.

Below the point where the film 14 is wrapped around the filling spout 10 are three additional guide rollers 36, one on each side of the anvil 34 and a third directly over the anvil 34. Guide rollers 36, in cooperation with the anvil 34, keep the zipper strip 30 longitudinally aligned beneath the film 14 of the tube 16 on the outside of the filling spout 10.

The anvil 34 may be used to introduce a tear string 38 from a spool 40 into the space between the tube 16 and the zipper strip 30. This feature will be shown more clearly in subsequent figures.

Beneath guide rollers 36 on the filling spout 10 are three heat sealing bars 42 which seal the zipper strip 30 to the tube 16 along seal lines 44,46,48, one seal line for each of the three arms of the Y-type construction of the zipper strip 30. Two of the arms comprise the webs to which the profiles are attached and the third arm comprises an opening lip for the zipper. The zipper strip 30 and tear string 38 may be formed of a thermoplastic material, such as polyethylene. Similarly, for many products, the film 14 may be polyethylene or a similar thermoplastic, and hence the zipper strip 30 and tear string 38 may be heat bonded thereto. Alternatively the tear strip may be formed of string or some other material encased in polyethylene.

Figure 2:
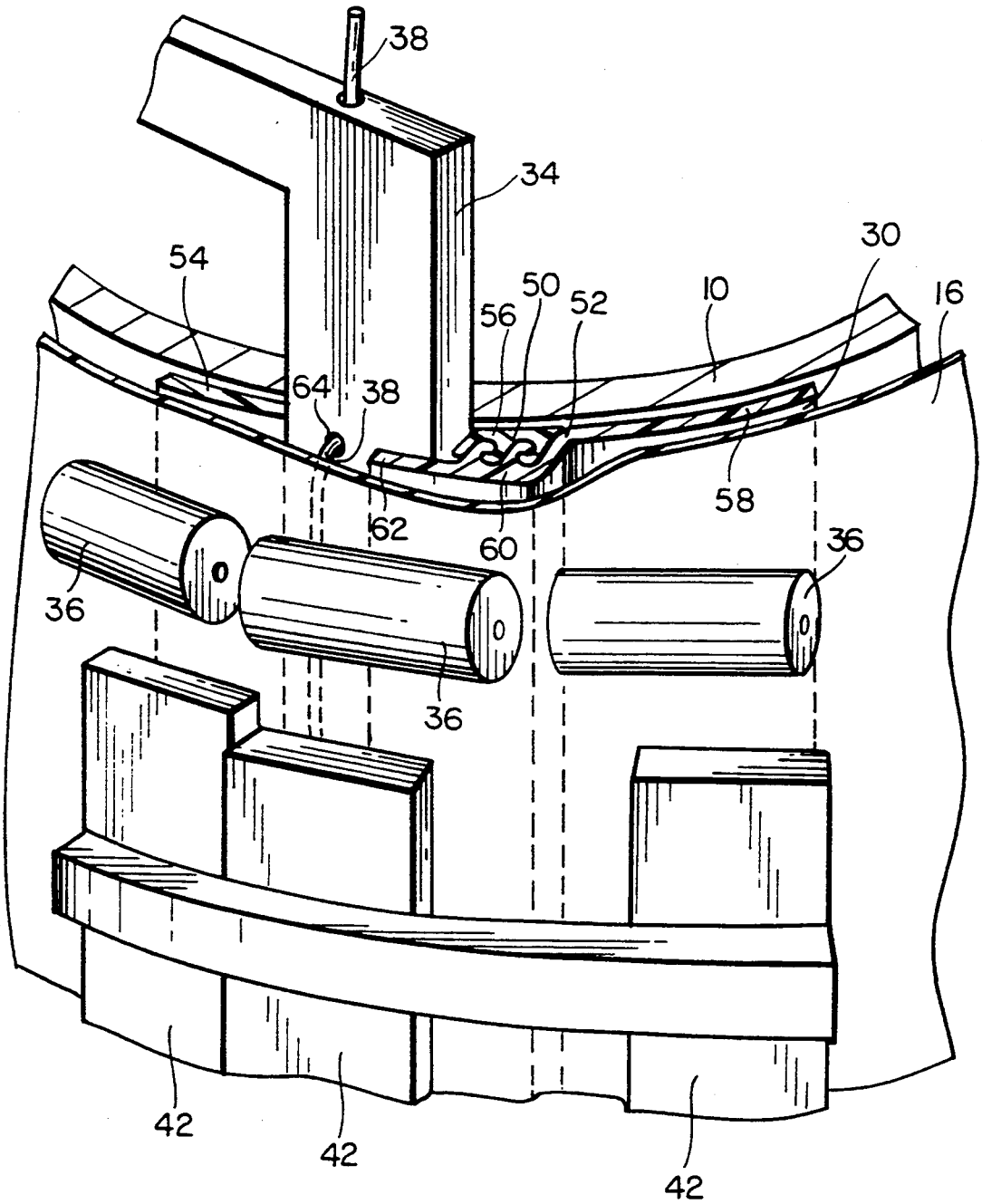
FIG. 2 is a more detailed view of the sealing portion of the form-fill-and-seal machine shown in FIG. 1.

FIG. 2 is a more detailed view of a portion of the form-fill-and-seal machine shown in FIG. 1. Zipper strip 30 comprises a first interlocking profile member 50 and a second interlocking profile member 52. First interlocking member 50 has a web 54 and a profile section 56. Second interlocking member 52 has a web 58, a profile section 60, and an opening lip 62. Web 54, web 58 and opening lip 62 are roughly oriented to describe the letter "Y". This is the reason for describing the zipper strip 30 as being of a Y-type construction.

Tube 16 of film 14 is between the zipper strip 30 and the guide rollers 36 and heat sealing bars 42. Zipper strip 30, in turn, abuts against the outer surface of the filling spout 10 within the tube 16, and is ultimately within the bag 28.

The tear string 38 may be fed through the anvil 34, and out of the anvil, such as through hole 64 at a point above the guide rollers 36, below which it will be sealed to the inside of tube 16 by the middle of the three heat sealing bars 42. The anvil 34 also maintains the separation between the web 54 and the opening lip 62, and ensures that web 54 and opening lip 62 are not sealed together when the middle of the three heat sealing bars 42 seals the tube 16 to the opening lip 62. The two outer sealing bars 42 seal the tube 16 to webs 54,58.

Figure 3:
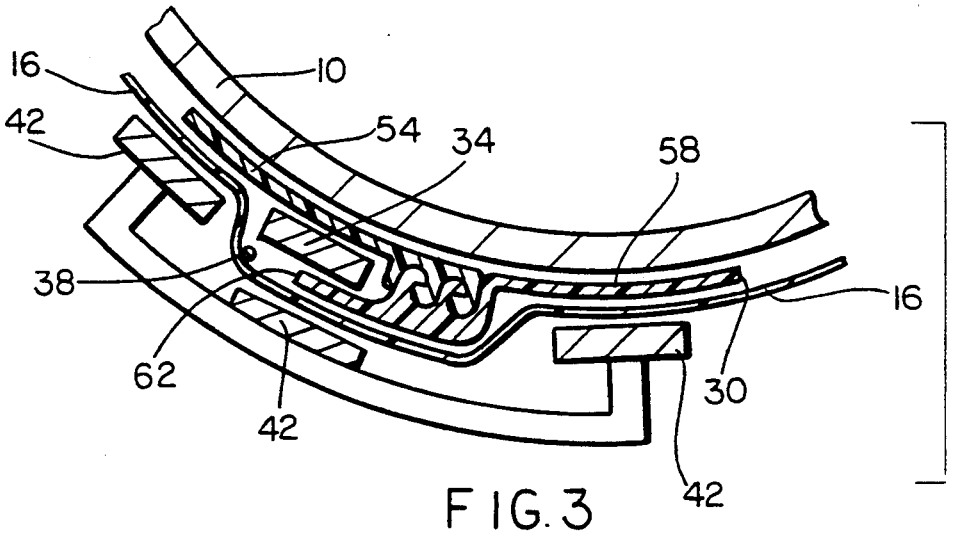
FIG. 3 is a partial cross-section taken as indicated by line 3—3 in FIG. 1.

FIG. 3 is a partial cross section taken as indicated by line 3—3 in FIG. 1 at a point in time before heat sealing bars 42 seal tube 16 to zipper strip 30. As may be readily noted, the anvil 34 prevents the middle heat sealing bar 42 from sealing the opening lip 62 to web 54, but allows the tube 16 to be sealed to both the opening lip 62 and the tear string 38. The two outer heat sealing bars 42 seal the tube 16 to web 54 and to web 58. This figure also shows the position of the tear strip 38 with respect to the opening lip 62 by which a user gains access to the opening lip after the finished bag is severed along the tear strip.

Figure 4:
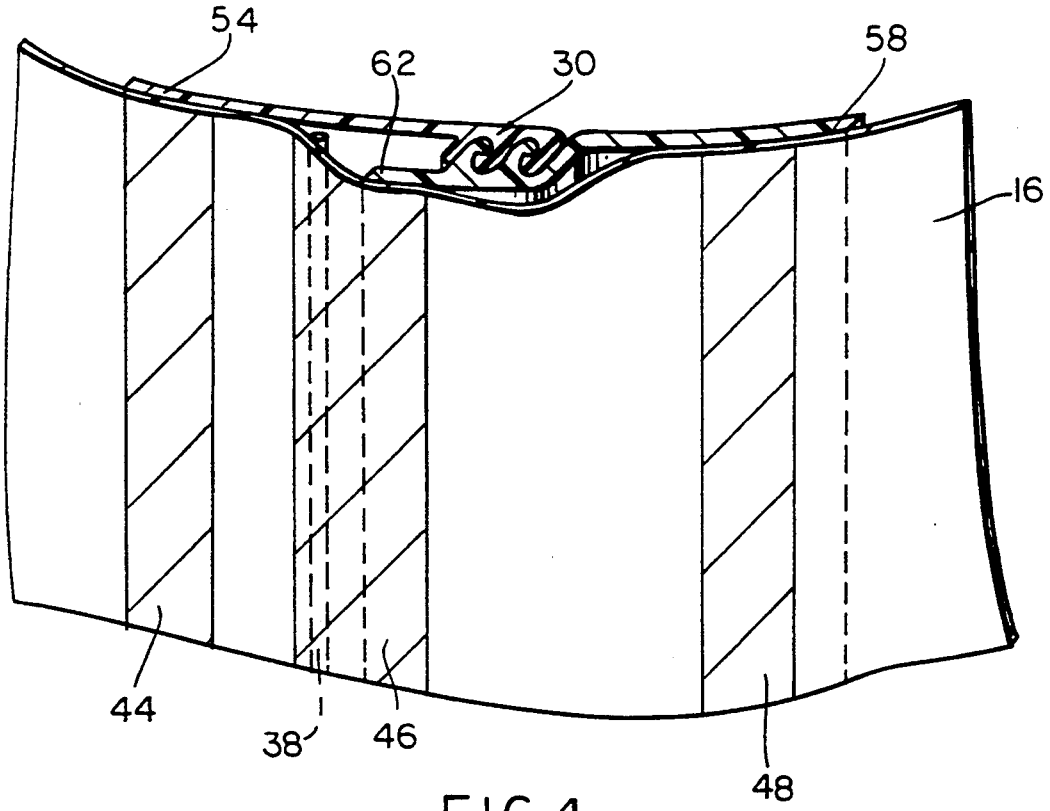
FIG. 4 is a partial cross section taken as indicated by line 4—4 in FIG. 1.

FIG. 4 is a partial cross section taken as indicated by line 4—4 in FIG. 1 at a point in time after heat sealing bars 42 have sealed tube 16 to zipper strip 30. Tube 16 is sealed to zipper strip 30 along seal lines 44,46,48. Seal line 44 is the joint between tube 16 and web 54; seal line 46 is the joint between tube 16 and opening lip 62 and includes tear string 38; and seal line 48 is the joint between tube 16 and web 58.

Figure 5:
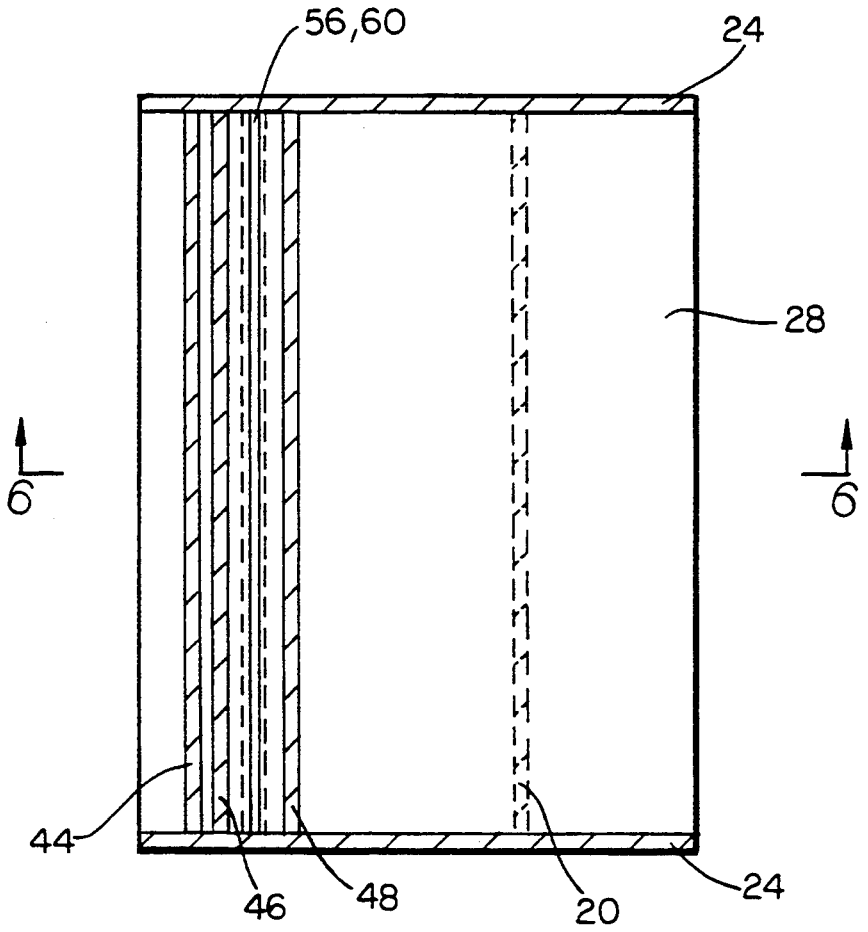
FIG. 5 is a plan view of a reclosable package made in accordance with the present invention.

FIG. 5 is a plan view of a bag 28 made in accordance with the present invention. Bag 28 includes two transverse seams 24 made by heat sealing bars 26, and a longitudinal seam 20, which is on the back side thereof in the view given in FIG. 5. Seal line 44,46,48 go across the bag, and interlocked profile sections 56,60 are between seal lines 46 and 48.

Figure 6:
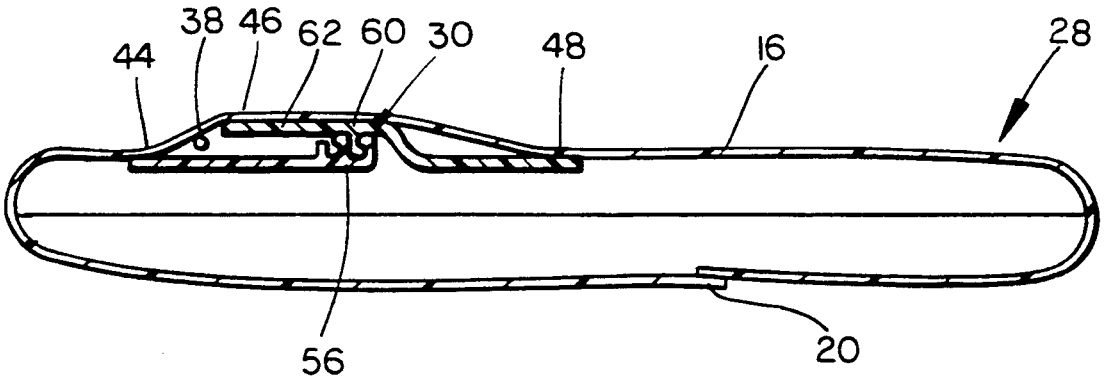
FIG. 6 is a cross section of the reclosable package taken as indicated by line 6—6 in FIG. 5.

FIG. 6 is a cross section of the bag 28 taken as indicated by line 6—6 in FIG. 5. Longitudinal seam 20, formed by sealing the overlapped lateral edges 18 of film 14 together, is on the back side of bag 28. Zipper strip 30 is inside the bag 28, and is sealed to the tube 16 along seal lines 44,46 and 48. Tear string 38 is also sealed or welded to the inside of the tube 16 adjacent to opening lip 62.

Figure 7:
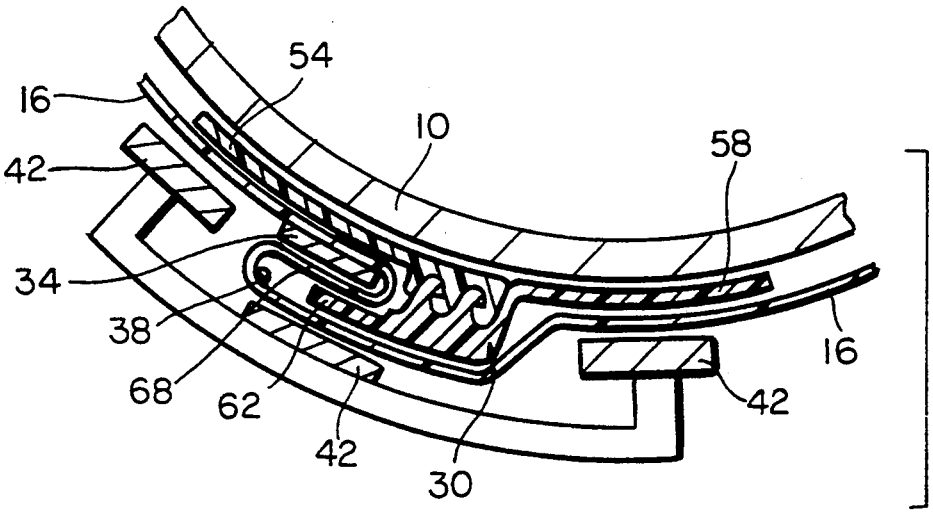
FIG. 7 is another partial cross section, analogous to that provided in FIG. 3, for a further embodiment of the present invention.
Figure 8:
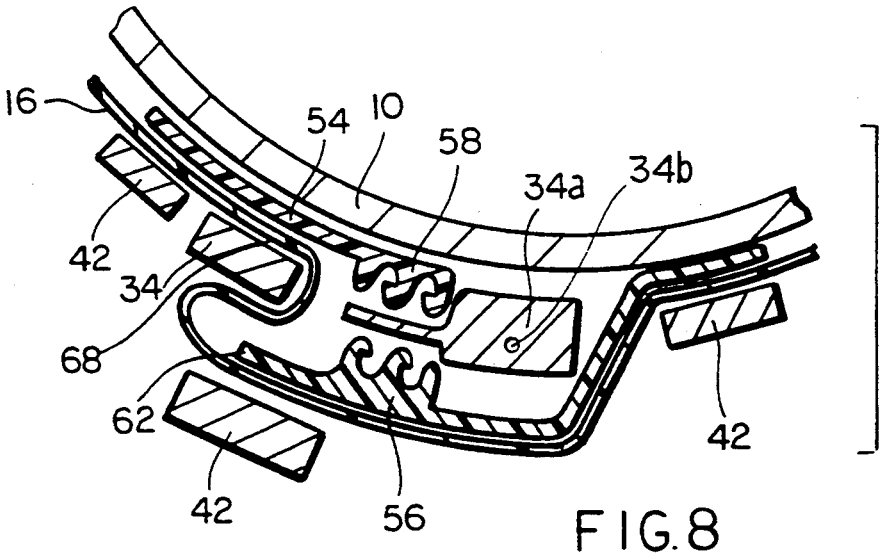
FIG. 8 is a partial cross section, analogous to that provided in FIG. 3, for another embodiment of the present invention.
Figure 9:
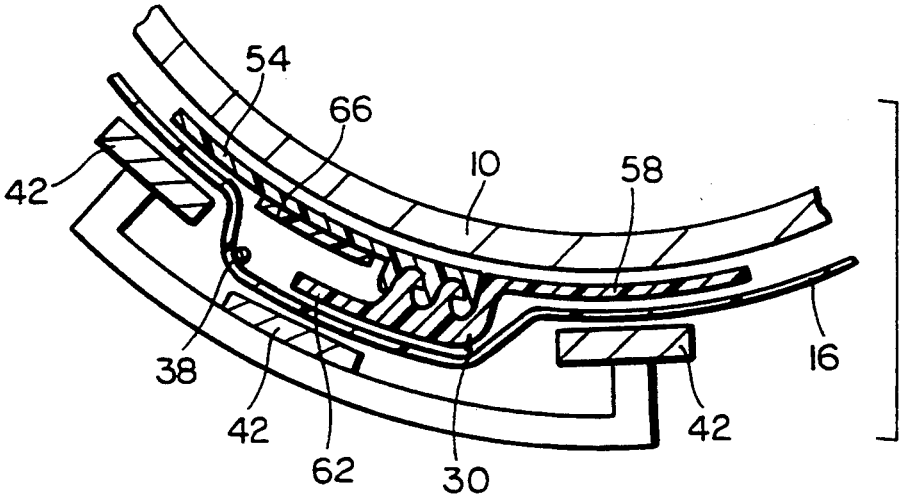
FIG. 9 is a partial cross section, analogous to that provided in FIG. 3, for an alternate embodiment of the present invention.

FIGS. 7, 8 and 9 are partial cross sections, analogous to that provided in FIG. 3, for two alternate embodiments of the present invention.

In the embodiment shown in FIG. 7, anvil 34 in addition to preventing the sealing of web 54 to opening 62, is used to create a double loop 68 in the tube 16. The loop 68 is located between web 54 and opening lip 62. The tear string 38 may be disposed within loop 68 at a point adjacent to opening lip 62.

In FIG. 8, a variation of the embodiment of FIG. 7, a second anvil **34*a* is provided to separate the profiles 56 and 58. This permits a jet of hot air to be introduced between the profiles via passage 34b** to soften them prior to making the cross-seal as described in copending application Ser. No. 039,644.

In FIG. 9, it may be observed that anvil 34 has not been provided to ensure that opening lip 62 does not become sealed to web 54 the middle heat sealing bar 42. Rather, a non-seal layer 66, of a polymeric material having a higher melting temperature than the other elements of zipper strip 30, is disposed on that portion of web 54 facing opening lip 62. Alternatively, the non-seal layer 66 may be disposed on that portion of the opening lip 62 facing web 54. Tear string 38, in this embodiment, is fed between tube 16 and non-seal layer 66 on web 54, and ultimately will be sealed or welded to tube 16.

Modifications to the above would be obvious to those of ordinary skill in the art, and would not bring the invention so modified beyond the scope of the appended claims.

What is claimed is:

1. A method for forming reclosable packages from a sheet of thermoplastic film on a form-fill-and-seal machine comprising the steps of:

feeding a continuous supply of zipper strip having first and second interlocking members toward a filling spout of said form-fill-and-seal machine, and longitudinally along a surface of said filling spout each of said interlocking members including a web portion and a profile portion;

feeding a continuous supply of said thermoplastic film having two lateral edges toward said filling spout;

wrapping said thermoplastic film about said filling spout and about said zipper strip;

forming a longitudinal seam in said thermoplastic film by sealing said two lateral edges to one another to produce a tube enclosing said zipper strip and said filling spout;

attaching said zipper strip web portions to said thermoplastic film on an inside surface of said tube;

periodically forming a transverse seam across said tube to produce individual reclosable packages; and separating said individual reclosable packages from one another.

2. The method as claimed in claim 1 further comprising the step of filling said reclosable plastic bags with a product by delivering said product through said filling spout, said filling step alternating with said step of forming a transverse seam.

3. The method as claimed in claim 1 wherein one of said first and second interlocking members has an opening lip adjacent thereto, and wherein said opening lip is attached to said thermoplastic film of said tube by being bonded thereto.

4. The method as claimed in claim 1 further comprising the steps of feeding a continuous supply of tear string between said zipper strip and said thermoplastic film, and attaching said tear string to said thermoplastic film on an inside surface of said tube.

5. The method as claimed in claim 3 wherein said opening lip faces said web of one of said first and second interlocking members, and wherein a surface of said web facing said opening lip has a non-seal layer, so that said web and said opening lip may not be bonded to each other when said opening lip is attached to said thermoplastic film.

6. The method as claimed in claim 3 wherein said opening lip faces said web of one of said first and second interlocking members, and wherein a surface of said opening lip facing said web has a non-seal layer, so that said web and said opening lip may not be bonded to each other when said opening lip is attached to said thermoplastic film.

7. The method as claimed in claim 3 wherein said opening lip faces said web of one of said first and second interlocking members, and further comprising the step of maintaining a separation between said opening lip and said web while said opening lip is being attached to said thermoplastic film, so that said opening lip may not be bonded to said web.

8. The method as claimed in claim 7 further comprising the step of folding said thermoplastic film of said tube into a loop between said opening lip and said web.

9. The method as claimed in claim 1 further comprising the step of maintaining a separation between said zipper strip profile portions while said zipper strip web portions are being attached to said film.

10. The method as claimed in claim 7 further comprising the step of maintaining a separation between said zipper strip profile portions while said zipper strip web portions and opening lip are being attached to said thermoplastic film.

* * * * *